US008272456B2

(12) United States Patent
Zupanick

(10) Patent No.: US 8,272,456 B2
(45) Date of Patent: Sep. 25, 2012

(54) SLIM-HOLE PARASITE STRING

(75) Inventor: Joseph A. Zupanick, Pineville, WV (US)

(73) Assignee: Pine Trees Gas, LLC, Pineville, WV (US)

( * ) Notice: Subject to any disclaimer, the term of this patent is extended or adjusted under 35 U.S.C. 154(b) by 519 days.

(21) Appl. No.: 12/347,706

(22) Filed: Dec. 31, 2008

(65) Prior Publication Data

US 2009/0173543 A1 Jul. 9, 2009

Related U.S. Application Data

(60) Provisional application No. 61/010,475, filed on Jan. 2, 2008.

(51) Int. Cl.
*E21B 17/18* (2006.01)

(52) U.S. Cl. ..... 175/215; 175/57; 175/205; 175/207; 175/69

(58) Field of Classification Search ..... 175/57, 175/205, 65, 69, 70, 215
See application file for complete search history.

(56) References Cited

U.S. PATENT DOCUMENTS 4,100,981 A * 7/1978 Chaffin ..... 175/60
4,697,651 A 10/1987 Dellinger
4,913,466 A 4/1990 Becker
5,069,297 A * 12/1991 Krueger et al. ..... 175/65
5,337,839 A 8/1994 Warren et al.
5,720,356 A * 2/1998 Gardes ..... 175/62
5,865,261 A 2/1999 Cooper et al.
6,065,550 A 5/2000 Gardes
6,280,000 B1 8/2001 Zupanick
6,357,523 B1 3/2002 Zupanick
6,412,556 B1 7/2002 Zupanick
6,425,448 B1 7/2002 Zupanick et al.
6,439,320 B2 8/2002 Zupanick
6,454,000 B1 9/2002 Zupanick
6,457,540 B2 10/2002 Gardes
6,478,085 B2 11/2002 Zupanick
6,497,556 B2 12/2002 Zupanick et al.
6,561,288 B2 5/2003 Zupanick
6,571,888 B2 6/2003 Comeau et al.
6,575,235 B2 6/2003 Zupanick et al.

(Continued)

OTHER PUBLICATIONS

Zupanick, Coal mine methane drainage using multilateral horizontal wells. Mining Engineering. Society for Mining, Metallurgy and Exploration, [online], Jan. 1, 2006 [retrieved on Apr. 2, 2009]. Retrieved from the Internet <URL: http://www.highbeam.com/doc/1P3-977857961.html>.

(Continued)

*Primary Examiner* — Kenneth L Thompson
*Assistant Examiner* — Sean Andrish
(74) *Attorney, Agent, or Firm* — Patton Boggs LLP

(57) ABSTRACT

A system for drilling a well having a wellbore includes a first pipe string positioned in the wellbore with a first annulus being present between the first pipe string and the wellbore. A second pipe string, smaller in diameter than the first pipe string, is positioned within the first pipe string to form a second annulus between the first pipe string and the second pipe string. The second pipe string is configured to be attached to a drill bit. A first rotator is operably associated with the first pipe string to rotate the first pipe string in a first direction at a first speed, and a second rotator is operably associated with the second pipe string to rotate the second pipe string in a second direction at a second speed.

34 Claims, 7 Drawing Sheets

U.S. PATENT DOCUMENTS 6,588,518 B2 7/2003 Eddison
6,595,301 B1 7/2003 Zupanick et al.
6,598,686 B1 7/2003 Zupanick
6,604,580 B2 8/2003 Zupanick et al.
6,604,910 B1 8/2003 Zupanick
6,607,042 B2 8/2003 Hoyer et al.
6,662,870 B1 12/2003 Zupanick
6,668,918 B2 12/2003 Zupanick
6,679,322 B1 1/2004 Zupanick
6,681,855 B2 1/2004 Zupanick et al.
6,688,388 B2 2/2004 Zupanick
6,708,764 B2 3/2004 Zupanick
6,722,452 B1 4/2004 Rial et al.
6,725,922 B2 4/2004 Zupanick
6,732,792 B2 5/2004 Zupanick
6,745,855 B2 6/2004 Gardes
6,802,379 B2 10/2004 Dawson et al.
6,848,508 B2 2/2005 Zupanick
6,851,479 B1 2/2005 Zupanick et al.
6,892,829 B2 5/2005 Livingstone
6,923,275 B2 8/2005 Gardes
6,942,030 B2 9/2005 Zupanick
6,945,755 B2 9/2005 Zupanick et al.
6,953,088 B2 10/2005 Rial et al.
6,962,216 B2 11/2005 Zupanick
6,964,298 B2 11/2005 Zupanick
6,964,308 B1 11/2005 Zupanick
6,976,533 B2 12/2005 Zupanick
6,976,547 B2 12/2005 Rial et al.
6,986,388 B2 1/2006 Zupanick et al.
6,988,548 B2 1/2006 Diamond et al.
6,988,566 B2 1/2006 Zupanick
6,991,047 B2 1/2006 Zupanick
6,991,048 B2 1/2006 Zupanick
7,007,758 B2 3/2006 Zupanick et al.
7,025,137 B2 4/2006 Zupanick
7,025,154 B2 4/2006 Zupanick
7,036,584 B2 5/2006 Zupanick et al.
7,048,049 B2 5/2006 Zupanick
7,073,595 B2 7/2006 Zupanick et al.
7,086,470 B2 8/2006 Diamond et al.
7,090,009 B2 8/2006 Zupanick
7,096,979 B2 8/2006 Haci et al.
7,134,494 B2 11/2006 Zupanick et al.
7,152,700 B2 12/2006 Church et al.
7,178,611 B2 2/2007 Zupanick
7,182,157 B2 2/2007 Zupanick
7,185,718 B2 3/2007 Gardes
7,204,327 B2 4/2007 Livingstone
7,207,395 B2 4/2007 Zupanick
7,213,644 B1 5/2007 Zupanick
7,222,670 B2 5/2007 Zupanick
7,225,872 B2 6/2007 Zupanick
7,243,738 B2 7/2007 Gardes
7,264,048 B2 9/2007 Zupanick et al.
7,311,150 B2 12/2007 Zupanick
7,353,877 B2 4/2008 Zupanick
7,360,595 B2 4/2008 Zupanick et al.
7,434,620 B1 10/2008 Zupanick
2001/0010432 A1 8/2001 Zupanick
2001/0015574 A1 8/2001 Zupanick
2002/0108746 A1 8/2002 Zupanick
2002/0117297 A1 8/2002 Zupanick
2002/0134546 A1 9/2002 Zupanick
2002/0148605 A1 10/2002 Zupanick
2002/0148613 A1 10/2002 Zupanick
2002/0148647 A1 10/2002 Zupanick
2002/0155003 A1 10/2002 Zupanick
2002/0189801 A1 12/2002 Zupanick
2003/0075322 A1 4/2003 Zupanick
2003/0173088 A1 9/2003 Livingstone
2003/0217842 A1 11/2003 Zupanick
2004/0031609 A1 2/2004 Zupanick
2004/0079553 A1 4/2004 Livingstone
2004/0084183 A1 5/2004 Zupanick
2004/0104030 A1 6/2004 Livingstone
2004/0149432 A1 8/2004 Zupanick
2004/0154802 A1 8/2004 Zupanick
2004/0159436 A1 8/2004 Zupanick
2004/0206493 A1 10/2004 Zupanick
2004/0226719 A1 11/2004 Morgan
2004/0244974 A1 12/2004 Zupanick
2005/0029016 A1* 2/2005 Self et al. ..... 175/74
2005/0079063 A1 4/2005 Zupanick
2005/0087340 A1 4/2005 Zupanick
2005/0103527 A1 5/2005 Church et al.
2005/0115709 A1 6/2005 Zupanick
2005/0133219 A1 6/2005 Zupanick
2005/0167156 A1 8/2005 Zupanick
2005/0211471 A1 9/2005 Zupanick
2005/0211473 A1 9/2005 Zupanick
2005/0257962 A1 11/2005 Zupanick
2005/0284664 A1 12/2005 Riel et al.
2006/0096755 A1 5/2006 Zupanick
2008/0060571 A1 3/2008 Zupanick
2008/0060799 A1 3/2008 Zupanick
2008/0060804 A1 3/2008 Zupanick
2008/0060805 A1 3/2008 Zupanick
2008/0060806 A1 3/2008 Zupanick
2008/0060807 A1 3/2008 Zupanick
2008/0066903 A1 3/2008 Zupanick
2009/0084534 A1 4/2009 Zupanick

OTHER PUBLICATIONS

International Search Report and Written Opinion date mailed Feb. 13, 2009; PCT International Patent Application No. PCT/US08/88654.

* cited by examiner

SLIM-HOLE PARASITE STRING

CROSS-REFERENCE TO RELATED APPLICATIONS

This application claims the benefit of U.S. Provisional Application No. 61/010,475 filed Jan. 2, 2008, which is hereby incorporated by reference.

BACKGROUND OF THE INVENTION

Under-Balanced Drilling

When drilling oil or gas wells, it is often desirable to drill certain formations in an under-balanced condition. Under-balanced drilling means that the hydrostatic column of drilling fluid is less than the reservoir pressure of the formation being drilled. Drilling under-balanced can be especially important when drilling horizontal wells in coal seams.

Coal seams typically possess certain permeability due to a natural cleat system. Under-balanced drilling is important in order to protect that permeability. If a coal seam well is drilled over-balanced, drilling fluid, and the solid material within the drilling fluid, can invade the cleat system of the coal. This will cause damage to the natural permeability and will likely hinder future gas production. Another problem associated with overbalanced drilling is "lost circulation". This can be a problem in horizontal coal wells particularly after a large amount of horizontal footage has already been drilled. As drilling fluid is lost into the formation, it may be impossible to keep adequate drilling fluid returning to the surface, thus affecting both hole-cleaning, as well as the ability to maintain an adequate supply of drilling fluid at the rig site. Also related to lost circulation is the phenomenon known as differential sticking. When a negative pressure differential exists between the borehole and the formation, the drill pipe can become stuck against the wall of the wellbore.

There are a number of under-balanced drilling methods available. Frequently, a gas phase drilling fluid is selected. Compressible fluids such as air or nitrogen are usually mixed with small amounts of liquids to form a mist or foam. Another method of under-balanced drilling involves the use of what is commonly called a parasite string. A parasite string refers to an extra conduit that is installed in a well and used to inject a gas at a certain location in the well in order to reduce the density of the liquid drilling mud returns. From the point where the gas is injected, the fluid returning to the surface becomes less dense, and the hydrostatic pressure on the formation can be reduced to an under-balanced condition.

Use of Parasite Strings in Under-Balanced Drilling

Parasite strings are ideally suited for use in under-balance drilling operations since the primary drilling fluid flowing through the bit remains a non-compressible liquid drilling mud. The non-compressible nature of liquid drilling mud allows the use of simple, low-cost mud-pulse telemetry equipment to communicate with any down-hole survey instruments that are necessary for guidance while drilling directional or horizontal wells. Yet another benefit of mud-based fluids is that, compared to low viscosity fluids such as gases, foams, or mists, drilling mud has far superior hole-cleaning properties. Additionally, when compressible gas drilling fluids are used to power progressing cavity down-hole motors, fluctuation in weight on the bit can cause large fluctuations in the speed of the motor. High motor speeds and the associated motor vibration can significantly damage or reduce the life of the electronic guidance systems.

Numerous parasite configurations have been employed in the past. In some cases, a tubing string is run in the well alongside the casing, and both are then cemented into place. In another configuration, an annulus formed by an additional inner casing string forms the necessary conduit to convey the gas to the injection point. While both of these configurations can functionally form the additional gas conveying conduit, in either case, a larger borehole diameter and a larger curve radius are required when compared to a non-parasite well configuration.

As an example and referring to FIG. 1, consider a conventional horizontal well 110 that does not employ the use of a parasite string. The well 110 may be drilled with a drill bit 112 having a cutting diameter of 6¼ inches. The drill bit 112 is operably attached to a drill string 114. Drilling fluids are pumped through the drill string 114 by a mud pump 116 to turn the drill bit 112. Based on the size of the drill bit 112, a vertical section 118 that is 8¾ inches in diameter is drilled from a surface 120 of the well 110 to a point where a curved section 124 of the well 110 will begin, approximately 150 feet above a target formation 128. A casing 132 having a diameter of 7 inches is positioned in the vertical section 118 and cemented into place. A 6¼ inch hole is then be drilled out of the 7 inch casing 132 to create the curved section 124. In this particular example, the curved section 124 has a radius R, that is about 150 feet. Once the drill bit assumes a horizontal orientation, drilling with the 6¼ inch drill bit 112 continues to create a horizontal section 136. The horizontal section 136 extends a desired distance or until the target formation 128 is reached.

Referring to FIG. 2, a well 210 having a traditional parasite string configuration is illustrated. The well 210 includes a vertical section 216, a curved section 224, and a horizontal section 236 similar to well 110 of FIG. 1. In the illustrated example, it is desirable to inject a gas at a heel 211 of the curved section 224. The gas is provided by a compressor 215 to a parasite string 240 concentrically positioned around a drill string 214. The drill string 214 is attached to a drill bit 212 that is used to drill the well 210. In conventional parasite string configurations, the parasite string 240 is sized to allow the drill bit 212 to pass through the parasite string 240. This allows the drill string 214 and drill bit 212 to be removed from the well 210 without removing the large-diameter parasite string 240.

In the example illustrated in FIG. 2, the drill bit 212 is sized the same as the drill bit 112 of FIG. 1, namely to provide a cutting diameter of 6¼ inches. The parasite string 240 is sized to be 7 inches in diameter to allow the drill bit 212 to pass through the parasite string 240. Because of the rigidity of the 7 inch, steel-casing parasite string 240, the curved section 224 of the well 210 must have a radius, R, of 500 feet instead of the 150 foot radius associated with well 110 of FIG. 1. In addition, because the 7 inch parasite string 240 is now an inner string, an outer casing 244 having a diameter of 9⅝ inches must now be set. A further problem arises in selecting a hole-diameter for the curved section 224. Conventionally, an 8¾ inch bit would be selected to drill out of the 9⅝ inch outer casing 244; however, this size hole would not provide adequate clearance for the collars (i.e. couplings) associated with the 7 inch parasite string 240. As such, a hole opener is run below the outer casing 244 to enlarge the curved section 224 of the well 210 below the outer casing 244 from 8¾ inches to approximately 10 inches.

The alternate configuration of utilizing a non-concentric gas injection tubing string alongside the 7 inch casing provides no greater savings in efficiency. In this configuration, both a 7 inch casing and a 2⅜" gas injection string are connected and simultaneously run into the well side-by-side (not shown). Unfortunately, compared to non-parasite drilling well configurations, enlarged hole-sizes are again required to accommodate a 2⅜ inch tubing string beside the 7 inch parasite string 240. There are also complications in running the relatively fragile tubing beside the 7 inch casing.

Extended Reach Drilling

Extending the reach of a horizontal well is a cost efficient method of adding additional production and reserves to the well for a relatively small incremental drilling cost. This is particularly true for horizontal wells, where the fixed cost components of drilling the well, such as building the access road and location, constructing surface facilities, setting surface casing and drilling the curve to horizontal, can easily exceed the cost of drilling the horizontal section of the well. Most often, the ultimate length that a well can be drilled is determined by the friction of the drill pipe rotating and sliding against the walls of the wellbore.

In drilling vertical wells, maintaining adequate weight on the drill bit is not a problem. In horizontal drilling however, the weight of the drill pipe in the vertical section of the well must be sufficient to push the drill-pipe out into the horizontal section of the well. When the friction forces of the pipe sliding in the horizontal section of the well approaches the gravity force (weight) of the pipe in the vertical section, insufficient weight is applied to the bit, and drilling efficiency initially slows, then stops. Since coalbed methane is typically produced from shallow formations, insufficient weight on the bit frequently limits the reach or length of these wells. Various techniques are employed to extend the reach of shallow horizontal wells. These reach extending methods can be grouped into two broad categories; 1) those that reduce the friction of the drill pipe, and 2) those that increase the weight applied to the drill-pipe.

Although friction reducing chemicals such as polymers can be added to the drilling mud, there is always a risk of formation damage if these chemicals invade the fracture or cleat system of the productive formation. As such, friction reduction is most often achieved by ensuring some amount of movement of the drill-pipe. In doing so, the friction that must be overcome is the kinetic or dynamic friction rather than static friction. Dynamic friction of the drill pipe in motion is typically only 60%-70% of the static friction of drill pipe at rest. Rotary-steerable directional drilling systems are available that allow the well to be directionally steered while the drill-pipe remains in constant rotational motion. These systems perform well, but they are relatively expensive to build and maintain.

More commonly, horizontal drilling utilizes a down-hole motor with an oriented bend to directionally steer the well. In order to break the static friction, frequently the driller simply "rocks" the drill pipe back-and-forth, alternating with a small amount of clockwise and counter-clockwise rotation. Although attempts have been made to automate this process, it remains a relatively imprecise technique. Further, since rotation is only applied in cycles of left, then right movement, at each direction change, movement of the drill pipe momentarily stops and static friction again prevails.

In some cases, a device can be deployed in the well that induces axial vibration into the drill-pipe. These devices are installed in the drill string and utilize a water hammer principle to agitate the drill-pipe. Although these devices can be quite efficient at creating friction-reducing vibration in the pipe, those same vibrations can cause damage to the electronic equipment used for guidance and telemetry in steering the well.

All references cited herein are incorporated by reference.

SUMMARY

The problems presented by existing systems and methods for drilling wells are solved by the systems and methods of the illustrative embodiments described herein. In one embodiment, a system for drilling a well having a wellbore is provided. The system includes a first pipe string positioned in the wellbore. A first annulus is present between the first pipe string and the wellbore. A second pipe string, smaller in diameter than the first pipe string, is positioned within the first pipe string to form a second annulus between the first pipe string and the second pipe string. The second pipe string is configured to be attached to a drill bit. A fluid source at or near a surface of the well is in communication with one of the first annulus and the second annulus to deliver a first fluid through the one of the first annulus and the second annulus to the other of the first annulus and the second annulus at a downhole location uphole of the drill bit. The other of the first annulus and the second annulus receives a drilling fluid from the second pipe string and permits delivery of a mixture of the drilling fluid and the first fluid from the downhole location to the surface of the well. An inner diameter of the first pipe string is sized to be less than a diameter of a hole being drilled.

In another embodiment, a system for drilling a well having a wellbore includes a first pipe string positioned in the wellbore to form a first annulus between the first pipe string and the wellbore. A second pipe string, smaller in diameter than the first pipe string, is positioned within the first pipe string to form a second annulus between the first pipe string and the second pipe string. The second pipe string is configured to be attached to a drill bit. A lubrication source is in communication with the second annulus and is capable of delivering a lubricant to the second annulus to reduce a coefficient of friction between the first pipe string and the second pipe string. An inner diameter of the first pipe string is sized to be less than a diameter of a hole being drilled.

In still another embodiment, a system for drilling a well having a wellbore includes a first pipe string positioned in the wellbore. A first annulus is present between the first pipe string and the wellbore. A second pipe string, smaller in diameter than the first pipe string, is positioned within the first pipe string to form a second annulus between the first pipe string and the second pipe string. The second pipe string is configured to be attached to a drill bit. A rotator is operably associated with the first pipe string to rotate the first pipe string.

In another embodiment, a method is provided for drilling a well having a wellbore. The method includes inserting a drill string operably attached to a drill bit into the wellbore. After inserting the drill string, a parasite string is inserted into the wellbore such that at least a portion of the drill string is within the parasite string. The drill string is rotated at a first speed, and the parasite string is rotated at a second speed to decrease a friction force between the drill string and the parasite string.

In yet another embodiment, a method of drilling a well having a wellbore includes inserting a drill string operably attached to a drill bit into the wellbore. After inserting the drill string, a parasite string is inserted into the wellbore such that at least a portion of the drill string is within the parasite string. A drilling fluid is delivered through the drill string to the drill bit and is returned to a surface of the well through a first annulus formed between the parasite string and the wellbore. A first fluid is delivered through a second annulus to a downhole location uphole of the drill bit. The second annulus is present between the drill string and the parasite string. The first fluid and the drill fluid are combined in the first annulus at the downhole location.

Other objects, features, and advantages of the invention will become apparent with reference to the drawings, detailed description, and claims that follow.

DETAILED DESCRIPTION OF THE PREFERRED EMBODIMENT

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

The illustrative embodiments described herein include systems and methods for drilling deviated and horizontal wells. There are numerous benefits to these systems and methods, including optimized under-balanced drilling, as well as reduced torque and drag. In one embodiment of the invention involving a horizontal well, after the well is drilled to the desired horizon, an outer drill-pipe is installed over the existing drill-pipe, forming substantially concentric strings of drill-pipe. The outer drill-pipe is only slightly larger than the inner drill-pipe, and thus both pipes have similar capabilities in regard to bending radius. The outer pipe is restrained at the surface to resist the rotational torque and axial thrust of the inner pipe. Drilling continues and an annulus between the two pipes serves as a conduit for introduction of a gas to achieve lower bottom-hole pressure. In order to reduce friction and extend the reach of the well, the outer pipe may be independently rotated in relation to the inner pipe such that a static-friction condition of one or both of the drill-pipes is eliminated. Lubricant may also be injected between the inner drill pipe and outer drill pipe sheath to further reduce friction.

Figure 1:
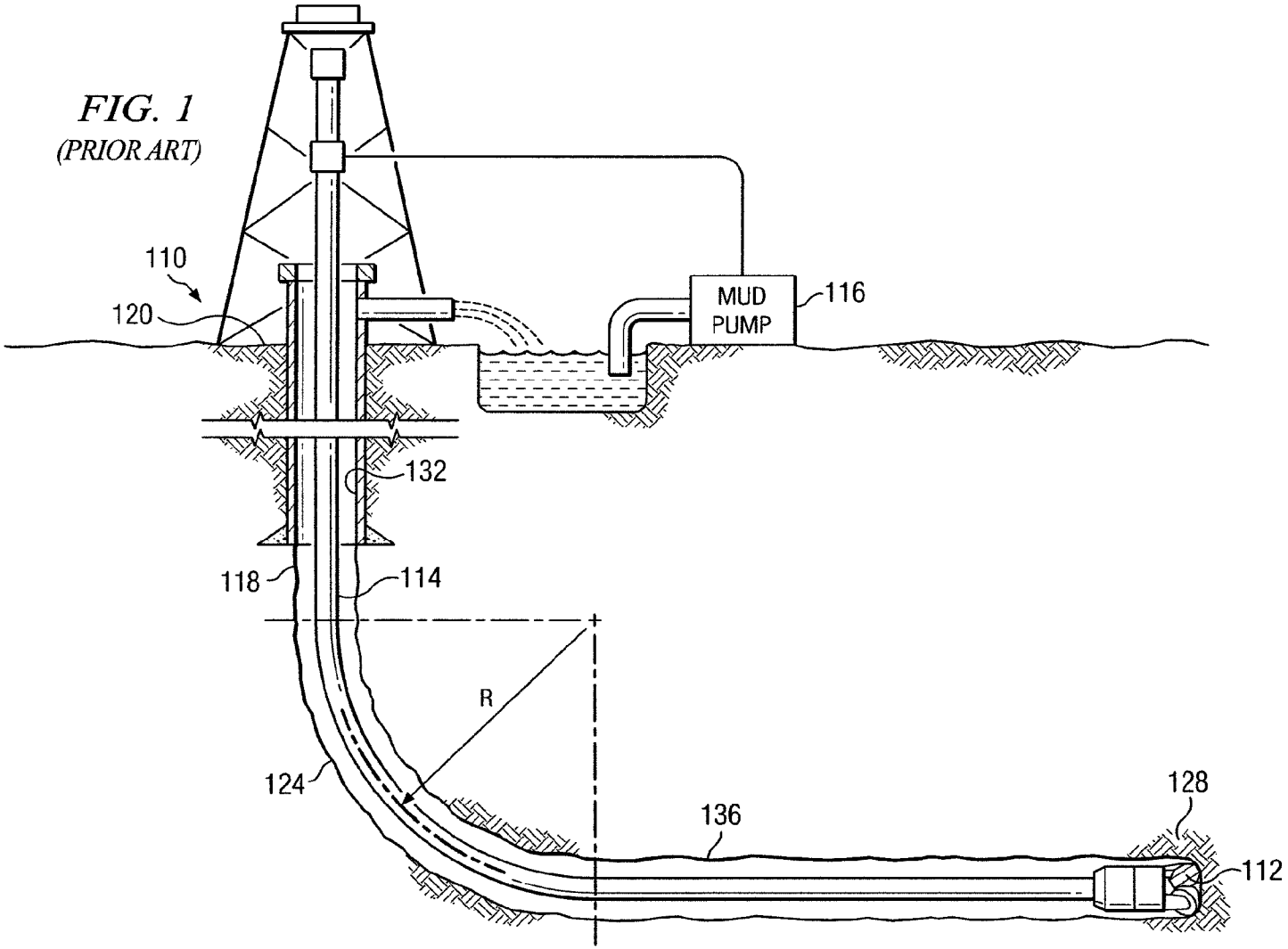
FIG. 1 (PRIOR ART)
FIG. 1 illustrates a schematic of a well having a drill string and a drill bit positioned in a substantially horizontal portion of the well.
Figure 2:
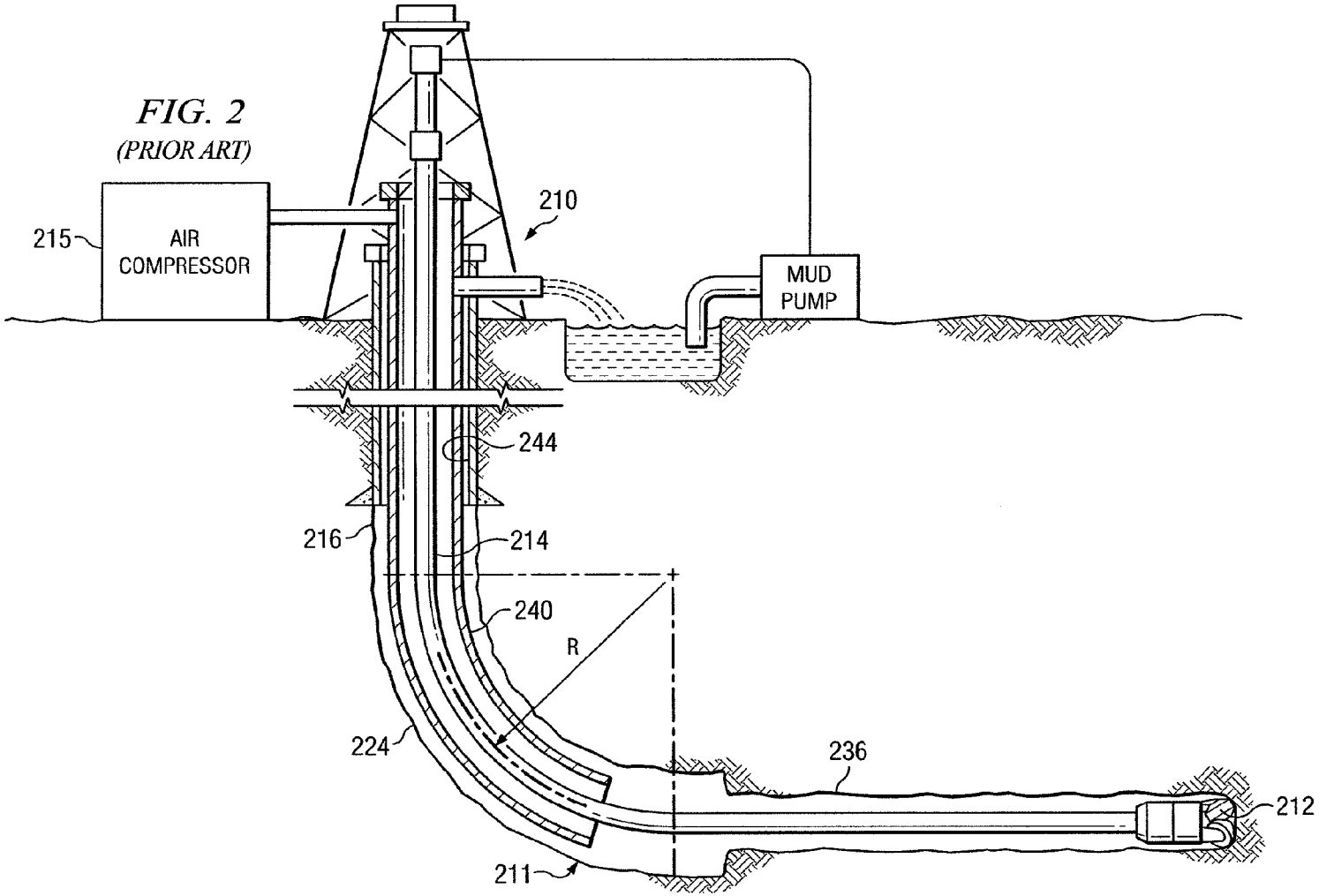
FIG. 2 (PRIOR ART)
FIG. 2 depicts a schematic of a well having a traditional parasite string configuration.
Figure 3:
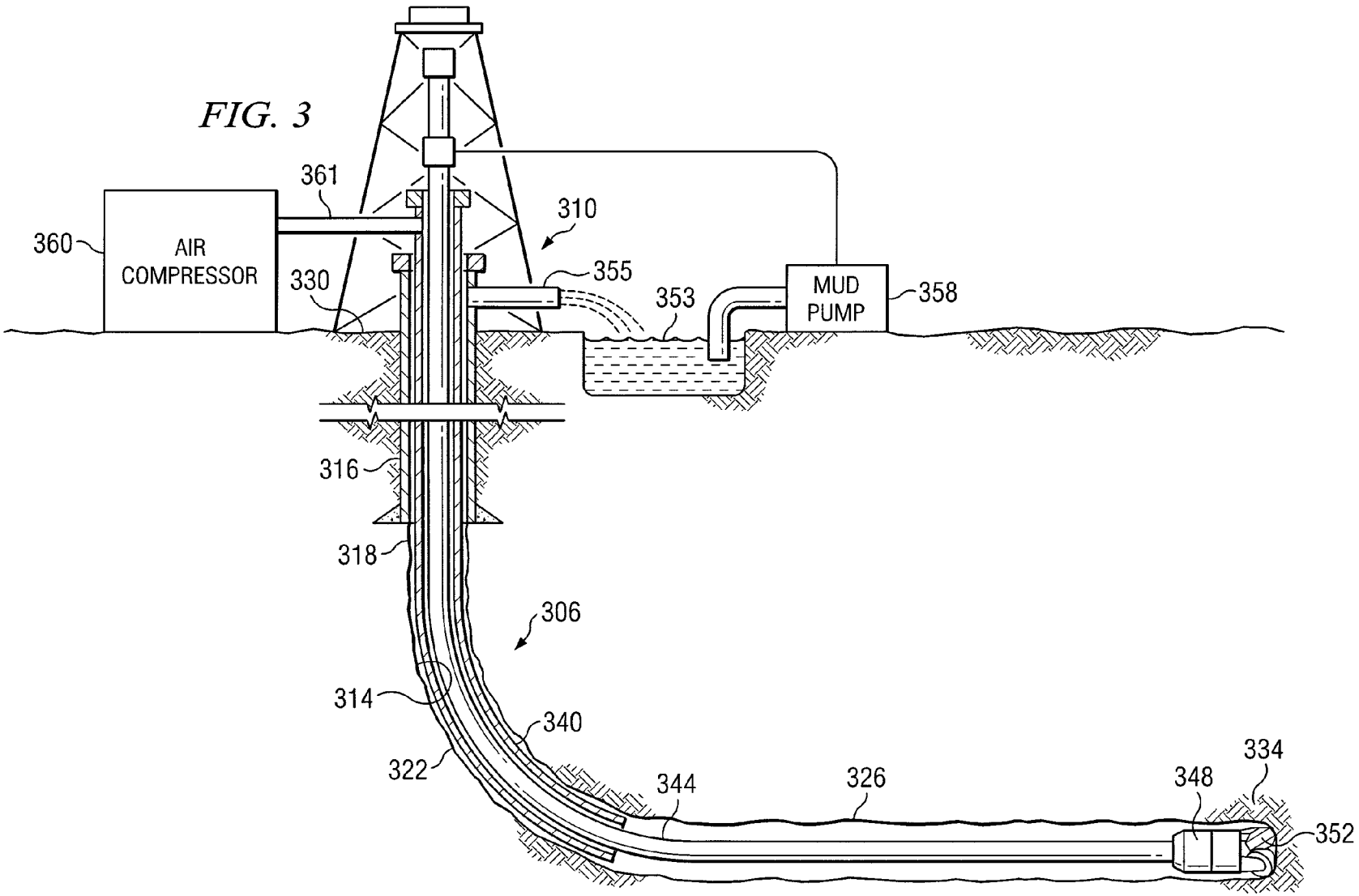
FIG. 3 illustrates a schematic of a slim-hole parasite system installed within a well according to an illustrative embodiment.
Figure 4:
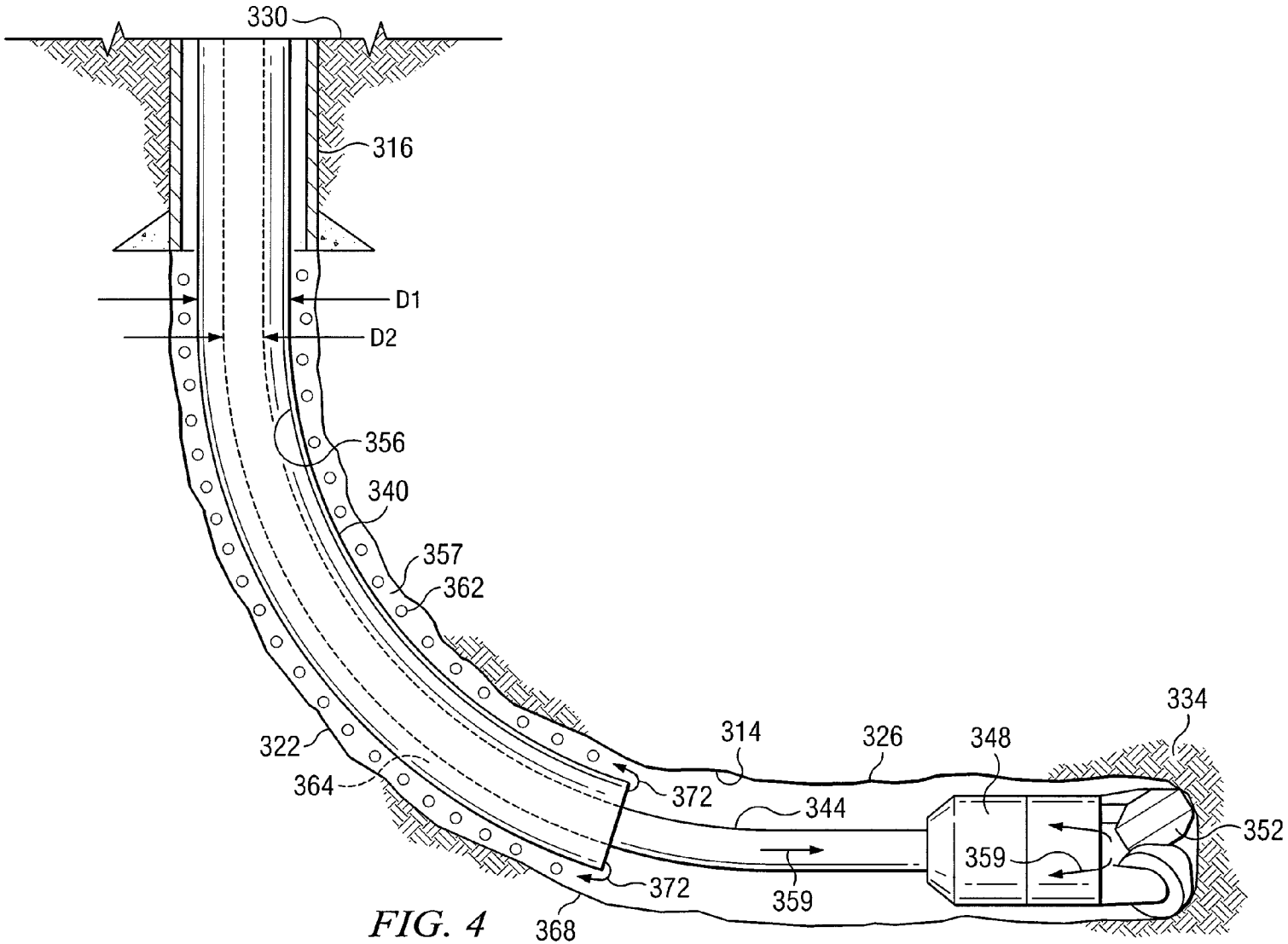
FIG. 4 depicts an enlarged bottom-hole schematic view of the slim-hole parasite system of FIG. 3.
Figure 5:
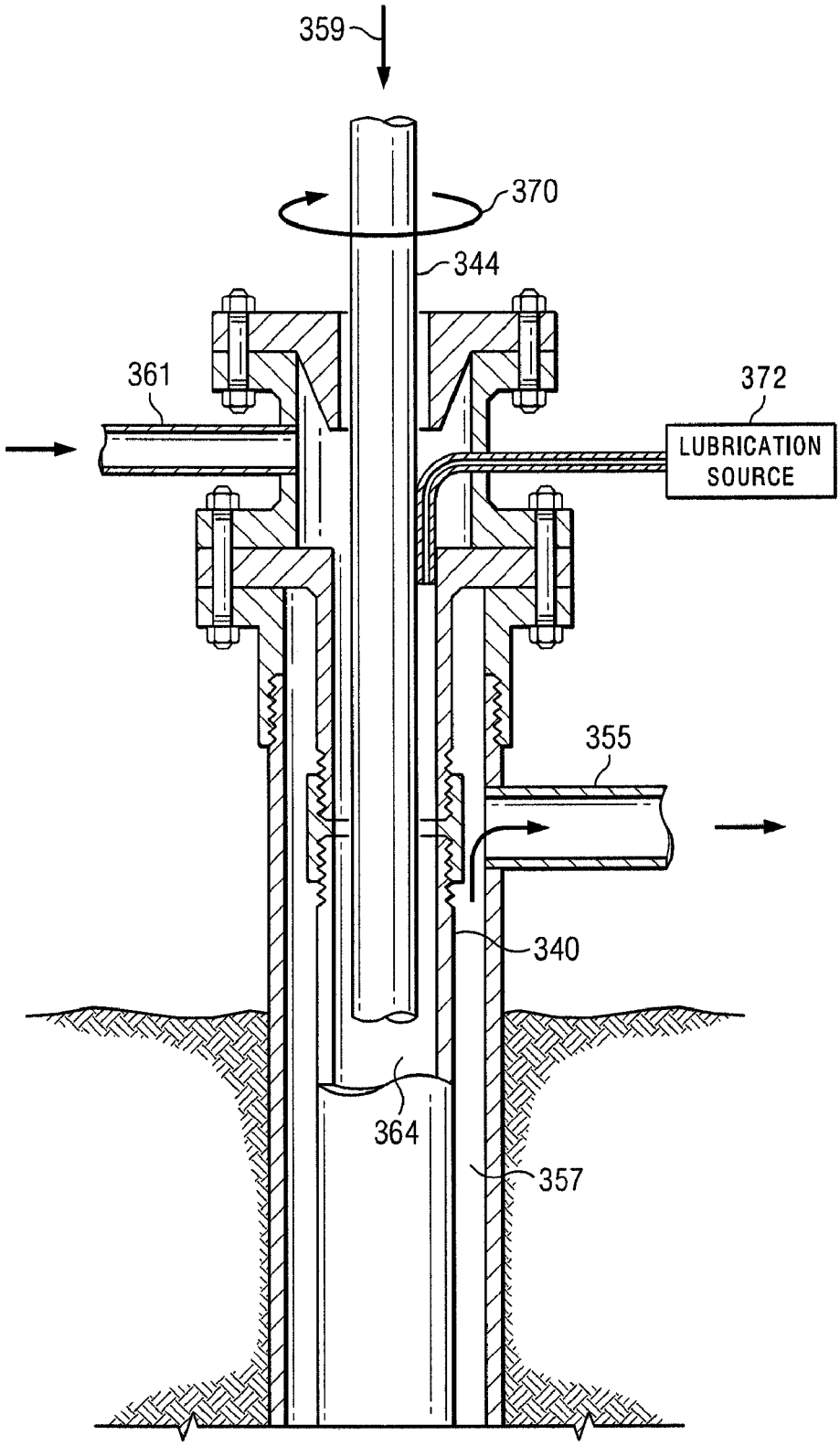
FIG. 5 illustrates an enlarged top-hole schematic view of the slim-hole parasite system of FIG. 3 at a surface of the well.

Referring more specifically to FIGS. 3-5, a slim-hole parasite system 306 for drilling a well 310 having a wellbore 314 according to an illustrative embodiment is provided. The well 310 is drilled using methods described in more detail below. A portion or all of the wellbore 314 may be cased with a casing 316, or alternatively, the wellbore 314 may be uncased. The well 310 may include a vertical section 318, a curved section 322, and a horizontal section 326. The vertical section 318 is substantially vertical and extends from a surface 330 of the well 310 to the curved section 322. The curved section 322 is substantially arcuate in shape and extends between the vertical section 318 and the horizontal section 326. The horizontal section 326 is substantially horizontal and extends from the curved section 322 to a target formation 334. The target formation 334 may include subterranean deposits including but not limited to oil, gas, minerals, or other deposits.

The system 306 includes a first pipe string, or parasite string 340 and a second pipe string, or drill string 344. The terms pipe string, drill string, or parasite string as used herein generally describe a plurality of individual sections of pipes, tubing, or conduit that are connected together by couplings or other means to form the string. While the cross-sectional shape of the pipes, tubing, or conduit could be any shape, typically the cross-sectional shape will be circular. The lengths of the individual pipes, tubing, or conduit may be any length that is easily manageable at a particular drill site, but for a typical well, the length may be between about 10 and 50 feet. When assembled, the pipe string, drill string, or parasite strings described herein may include a substantially continuous passage that permits flow of fluids within the passage.

The first pipe string 340 and the second pipe string 344 are positioned in the wellbore 314, and the second pipe string 344 is positioned within the first pipe string 340. The second pipe string 344 may be operably attached at a downhole end to a downhole motor 348, which is operably attached to and is capable of driving a drill bit 352. The first pipe string 340 is sized such than an inner diameter, D1, of a passage 356 of the first pipe string 340 is greater than an outer diameter, D2, of the second pipe string 344 (see FIG. 4). While the sizing of the first pipe string 340 allows the second pipe string 344 to reside within the passage 356 of the first pipe string 340, in one embodiment, the first pipe string 340 is sized such that the inner diameter D1 is not large enough to allow delivery or removal of the drill bit 352 through the passage 356. In one embodiment, the inner diameter D1 may be sized to be less than a diameter of the hole being drilled once the first pipe string 340 is in place.

In one embodiment, the first pipe string 340 is sized in such a manner to allow the first pipe string 340 to fit relatively snuggly over the second pipe string 344 similar to a sheath, and performing the function of the outer section of a sleeve bearing. In such an embodiment, the annular space between the two strings may be such that the smaller string is about one inch (1 in) less that the larger string. In other words, the difference between the inner diameter, D1, of the first pipe string 340 and the outer diameter, D2, of the second pipe string 344 is about one inch (1 in).

In another embodiment, the first and second pipe strings may be sized such that the ratio of the outer diameter, D2, of the second pipe string 344 to the inner diameter, D1, of the first pipe string 340 is greater than about 0.5 (D2/D1>about 0.5).

In another embodiment, the first and second pipe strings may be sized such that the acceptable radius of curvature of the first pipe string 340 is less than about three times (3×) the acceptable radius of curvature of the second pipe string 344. More preferably, the acceptable radius of curvature of the first pipe string 340 is less than about two times (2×) the acceptable radius of curvature of the second pipe string 344. As used herein, the term "acceptable radius of curvature" refers to a bending radius at which the pipe string substantially remains within its elastic bending limit and does not experience a failure of the coupling mechanisms associated with the pipe string.

In one embodiment, the second pipe string 344 is positioned substantially concentrically within the first pipe string 340. This may be accomplished by positioning spacers or bearings between the first pipe string 340 and the second pipe string 344, or alternatively may be accomplished without spacers or bearings. Similarly, the first and second pipe strings may or may not be axially constrained relative to one another. In one embodiment, each of the individual sections of pipe, tubing or conduit that make up the first pipe string 340 is substantially axially constrained relative to one of the individual sections of pipe, tubing or conduit that make up the second pipe string 344. Axial constraint of each section of the first pipe string 340 relative to the section of second pipe string 344 that is nested within allows sections of the dual-pipe string to be more easily and quickly added to the well 310.

It is important to note that while the second pipe string 344 is described as being within the first pipe string 340, use of the term "within" is not meant to imply that the second pipe string 344 is surrounded or encompassed by the first pipe string 340 along the entire length of the second pipe string 344. In the embodiment illustrated in FIGS. 3 and 4, for example, the length of the second pipe string 344 is greater than the length of the first pipe string 344. Because at least a portion of the second pipe string 344 is received by the first pipe string 340, the second pipe string 344 is still considered to be within the first pipe string 340.

Referring more specifically to FIGS. 3 and 4, a pump 358 such as a mud pump is positioned at a surface 330 of the well 310 and is in fluid communication with the second pipe string 344. The pump 358 delivers a drilling fluid to the downhole motor 348 and the drill bit 352 to power the downhole motor 348 and remove cuttings during operation of the drill bit 352. Arrows 359 represent the flow of the drilling fluid within the second pipe string 344 and near the drill bit 352. After passing through the downhole motor 348, the drilling fluid is returned to the surface 330 of the well 310 through a first annulus 357 formed between the first pipe string 340 and the wellbore 314. A return conduit 355 is fluidly connected to the first annulus 357 at the surface 330 of the well 310 to receive and route the drilling fluid to a reservoir 353. The fluid reservoir 353 also provides a source of drilling fluid from which the pump 358 is configured to draw.

Referring still to FIGS. 3 and 4, but also to FIG. 5, a gas source 360 such as an air compressor or other pressurized gas source is positioned at the surface 330 of the well 310 and is in fluid communication with the first pipe string 340 via a supply conduit 361. More specifically, the gas source 360 provides a pressurized gas 362 to a second annulus 364 formed between the first pipe string 340 and the second pipe string 344 such that the gas 362 is delivered to a downhole location. In the embodiment illustrated in FIGS. 3 and 4, the downhole location is located at a heel 368 of the well 310 and corresponds to the location of a downhole end of the first pipe string 340. In another embodiment, the first pipe string 340 may extend past the downhole location and instead allow the gas 362 to exit the first pipe string 340 through a hole (not shown) in the wall of the first pipe string 340.

In FIG. 4, flow of the gas 362 out of the second annulus 364 is represented by arrows 372. After exiting the annulus 364, the gas enters the first annulus 357 and mixes with the drilling fluid returning from the drill bit 352 to the surface 330. It should be noted that, in some instances, other fluids besides gas may be injected into the second annulus. For instance, at times it may be desirable to inject additional volumes of drilling fluid, whether gas or liquid, at the heal of the curve from horizontal to vertical for the purpose of providing greater annular velocity as the drill cuttings are carried vertically up the wellbore. It should also be noted that, different configuration of the flow of fluids within the first and second annulus could achieve the same results as those described above. For instance, the gas could be injected into the first annulus, and returns could flow up the second annulus.

Referring more specifically to FIG. 5, the second pipe string 344 may be rotated at a desired speed in a desired direction as indicated for example by arrow 370. In one embodiment, the second pipe string 344 may be rotated at a speed of between about one to ten revolutions per minute (1 to 10 rpm). The presence of the first pipe string 340 around the second pipe string 344, in conjunction with the rotational movement of the second pipe string 344 relative to the first pipe string 340, reduces frictional forces between the first pipe string 340 and the second pipe string 344. It should be noted that a similar reduction in frictional forces may be obtained by rotating the first pipe string 340 instead of the second pipe string 344. An embodiment in which either pipe string individually, or both pipe strings simultaneously, are capable of being rotated is described in more detail below with reference to FIG. 6.

To further reduced friction, a lubrication source 372 may be provided in communication with the second annulus 364 via a conduit similar to supply conduit 361. In one embodiment, a small amount of lubricant is injected in the gas stream injected into the second annulus 364. This lubricant is carried along with the gas in the second annulus 364. Once the pipe surfaces are initially coated, only a small amount of additional lubricant needs to be injected to compensate for loss. The mating surfaces of the first pipe string 340 and second pipe string 344 can now easily slide because the friction coefficient of the lubricated pipe is only 20%-30% that of non-lubricated pipe.

Figure 6:
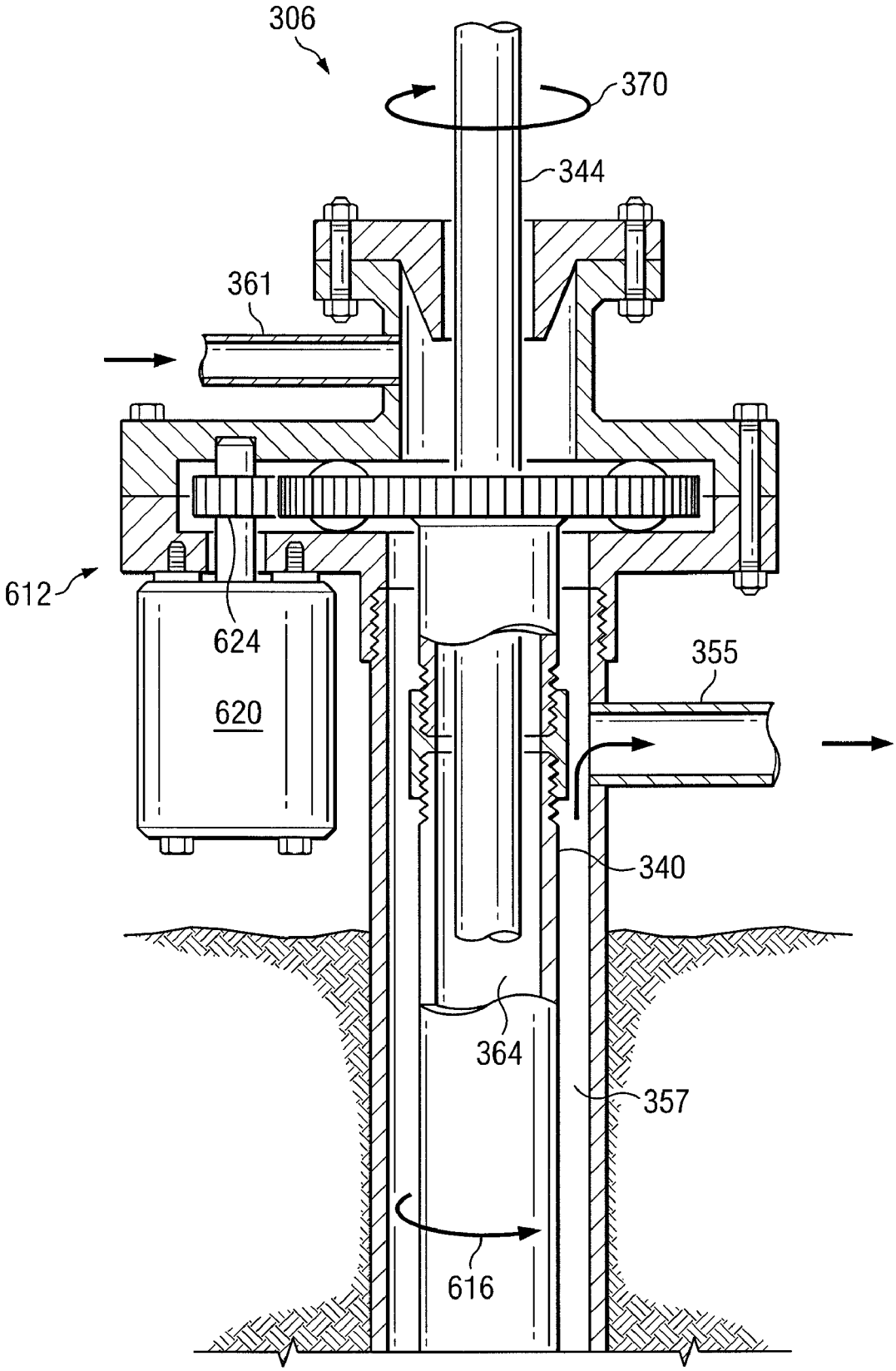
FIG. 6 depicts an enlarged schematic of the slim-hole parasite system of FIG. 3 at a surface of the well, the system having a rotator according to an illustrative embodiment.

Referring to FIG. 6, in one illustrative embodiment, the system 306 illustrated in FIGS. 3-5 or similar systems may include a rotator 612 operably associated with the first tubing string 340 to rotate the first tubing string 340 in a first direction as indicated by arrow 616 at a first speed. The rotator 612 is an assembly of components that cooperate to rotate a tubing string. In the illustrated embodiment, the rotator 612 includes a motor 620 operably connected to a gear assembly 624. The gear assembly 624 transmits rotational power from the motor 620 to the first tubing string 340. It should be noted that power transmission between the motor 620 and the first tubing string 340 may similarly be accomplished using a chain drive, a belt drive, or any other power transmission means.

As indicated by arrow 370, second pipe string 344 is rotated in a second direction at a second speed. Second pipe string 344 may be rotated by a second rotator (not shown), or alternatively may be rotated by rotator 612. While arrows 616 and 370 in FIG. 6 indicate opposite directions of rotation of the first and second pipe strings, the first and second pipe strings may be rotated in the same or opposite directions at the same or different speeds.

In one embodiment, the first pipe string 340 may be rotated at a speed of between about one to ten revolutions per minute (1 to 10 rpm), while the second pipe string 344 is not rotated, as would be the case in coil tubing drilling, or during the slide drilling phase of a jointed pipe directional drilling operation. Although not being rotated itself, the friction forces exerted upon the second pipe string are dynamic rather than static in nature, thus allowing a greater amount of axial and rotational forces to be transmitted to the bit. This low speed rotation of the first pipe string consumes little power and creates little wear of the first pipe string 340.

In still another embodiment, either the first pipe string 340 or the second pipe string 344 may be permitted to freely rotate without being directly or actively powered by the rotator that rotates the other of the first and second pipe strings. In this configuration, rotation may be imparted via frictional forces to the "freewheeling" pipe string by the pipe string that is actively rotated.

Figure 7:
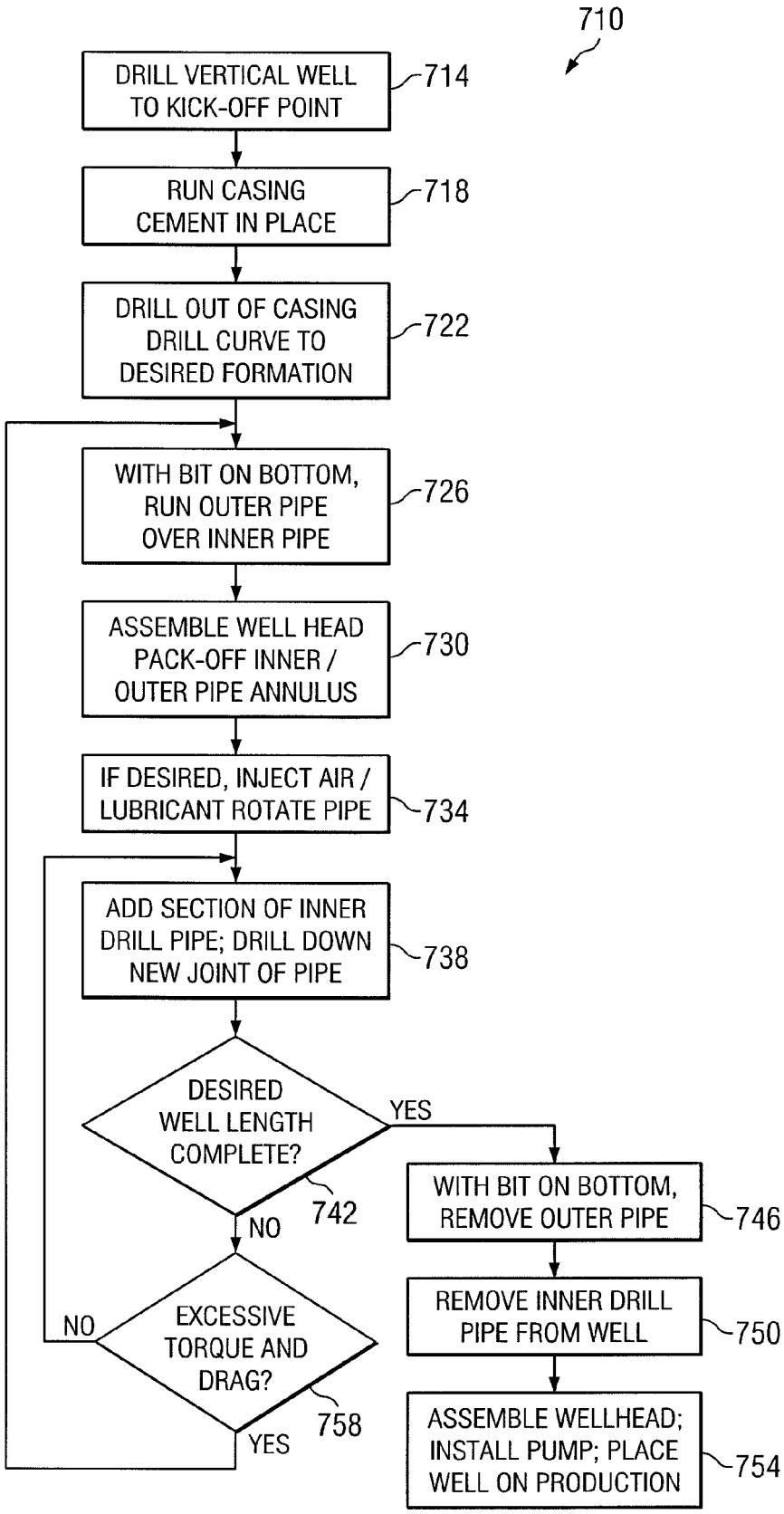
FIG. 7 illustrates a method of drilling a well according to an illustrative embodiment.

Referring to FIG. 7, a method 710 for drilling a well includes drilling a vertical section of the well to a kick-off point 714, and then affixing a casing within the vertical section of the well 718. At 722, drilling is continued out of the casing until, and a curved section is drilled to a desired formation. At 726, with the drill bit in the well near or below the curved section, an outer pipe, or parasite string is run into the well over the inner drill string. A well head is assembled at a surface of the well, and the annuluses associated with the inner and outer pipes are packed off at 730. At 734, a lubricant and/or a gas is injected into the annulus between the inner and outer pipe, and at least one of the inner and outer pipes is rotated. At 738, drilling continues, and a new section of inner pipe is added as needed. When the well has reached a desired length (see 742), the outer pipe may be removed from the well, as indicated at 746. The inner pipe and drill bit may then be removed from the well at 750. Following removal of the outer and inner pipes, a pump may be installed and the well placed in production, as indicated at 754.

Referring again to 742, if the desired length of the well has not been reached, a determination may be made at 758 regarding the amount of torque and drag that is being placed on the inner drill pipe. If an excessive amount of torque or drag is present, then additional lengths of outer pipe may be placed in the wellbore over the inner pipe, as indicated by step 726. If the torque and drag are not excessive, drilling continues at 738, and new sections of inner drill pipe are added to the well as needed to increase the length of the well.

The dual pipe string configuration of the slim-hole parasite system 306, and the methods described herein, provide multiple benefits, one of which is the ability of the system 306 to promote under-balanced drilling without the inherent problems associated with existing parasite systems. Due to the closely matched relative sizing of the first pipe string 340 and second pipe string 344, the system 306 is capable of providing gas injection downhole without requiring the drilling or formation of wellbores having excessively large diameter.

To better illustrate this advantage, an example is provided for comparison with the example previously presented utilizing a traditional parasite string. In the illustrative example, a system similar to system 306 is used to drill, with 7 inch casing set above a 150 foot radius, 6¼ inch curved section. Upon the start of the drilling of the horizontal section, and with the bottom-hole assembly (i.e. drill motor and drill bit) resting on the bottom of the well, a 4½ inch parasite string is run over the 2⅞ inch drill string and then hung from the wellhead. Under-balanced drilling can then begin. As drilling mud is pumped down the drill string, a gas is injected in the annulus between the 4½ inch parasite string and the drill string. The gas and drilling mud returning from the bit mix at the end of the 4½ inch parasite string. The aerated return mixture of drilling mud flows up to surface through the annulus formed by the 7 inch casing and the 4½ inch parasite string.

Another benefit of the slim-hole parasite system 306 is that the system 306 allows extension of the length of a well by reducing the downhole friction forces on the drill string. An additional benefit of reduced friction is the reduction of pipe wear. Drilling horizontal wells through even mildly abrasive formations can significantly limit the life of the drill pipe. The metal on metal contact of the drill pipe within its temporary outer sheath can be far less damaging than the drill-pipe rubbing against the exposed rock surface of the wellbore. The life of the drill-pipe can be yet further extended by the use of lubricants between the two metal surfaces.

Incremental friction reduction will occur for every incremental extension of the dual-string pipe. Although a first section of the parasite string may be run immediately after the well has landed horizontally (for introduction of gas in a parasite drilling configuration), additional sections of the friction-reducing parasite string may be added at desired intervals while drilling as the length of the well increases. At some point, accumulated drag forces may dictate the maximum length of the rotating parasite string, at which point drilling would continue with no additional sections of the parasite string being added.

Yet another benefit of the illustrative embodiments includes the ability of the dual pipe string configuration to prevent the phenomena known as "helical lock-up". Helical lock-up occurs when drilling with relatively slim diameter drill-pipe within a relatively large confining wellbore diameter. The problem can be aggravated when drilling shallow wells in which a "pull-down" rig is utilized to add weight to the bit by pushing the drill pipe into the well. In these situations, the drill pipe will buckle and helically spiral about the wellbore. The downward force of the drill pipe is translated to an outward force of the drill pipe against the wall of the well, and the drill pipe becomes "locked" and no further movement occurs. In utilizing the slim diameter outer drill-pipe sheath, or parasite string, surrounding the inner drill-pipe, similar in action to the outer jacket of a throttle cable, helical lock-up is prevented from occurring. As such, a greater amount of the drill-rig-applied force pushing on the drill pipe is transferred to the bit.

Numerous enhancements and embellishments to the dual pipe string drilling configuration are envisioned. Broadly, the concept involves utilizing a dual, substantially concentric pipe string while drilling, such that the two strings are independently free to rotate relative to and slide through one another. Torque and thrust for drilling are conveyed to the inner pipe. The outer pipe is restrained at the surface to resist any thrust transferred to the outer pipe by way of the axial movement of the inner pipe. It is envisioned that the outer pipe is only slightly larger than the diameter of the inner drill-pipe, yet smaller in diameter than the drill bit.

The dual pipe string configuration may be utilized in most conventional well configurations, and does not require a larger diameter wellbore. While the systems and methods of the illustrative embodiments are primarily described as being used in drilling wells to access subterranean deposits, it is important to note that these systems and methods could be applied to any situations where earthen or subterranean drilling is required. These systems and methods may also be used to drill wells having horizontal sections as described herein, or alternatively with wells that will not include horizontal sections. The benefits and advantages of the systems and methods are applicable to any well for which it is desired to reduce frictional forces during drilling or to inject a second circuit of drilling fluid at a point behind the bit.

It should be apparent from the foregoing that an invention having significant advantages has been provided. While the invention is shown in only a few of its forms, it is not just limited but is susceptible to various changes and modifications without departing from the spirit thereof.

I claim:

1. A system for drilling a well having a wellbore comprising:

a first pipe string positioned in the wellbore, a first annulus present between the first pipe string and the wellbore;

a second pipe string, smaller in diameter than the first pipe string, positioned within the first pipe string to form a second annulus between the first pipe string and the second pipe string, the second pipe string configured to be attached to a drill bit; and a fluid source at or near a surface of the well in communication with one of the first annulus and the second annulus to deliver a first fluid to the other of the first annulus and the second annulus at a downhole location uphole of the drill bit;

wherein the other of the first annulus and the second annulus receives a drilling fluid from the second pipe string and permits delivery of a mixture of the drilling fluid and the first fluid from the downhole location to the surface of the well;

wherein an inner diameter of the first pipe string is sized to be less than a diameter of the drill bit;

wherein the first pipe string and the second pipe string are each rotated at different speeds;

wherein in operation, the second pipe string is independently and axially moveable relative to the first pipe string.

2. The system according to claim 1 further comprising:

a return conduit in communication with the first annulus to receive the mixture of the drilling fluid and the first fluid.

3. The system according to claim 1, wherein the first fluid is a gas.

4. The system according to claim 1, wherein the first pipe string has a length less than a length of the second pipe string.

5. The system according to claim 1, wherein the wellbore is at least partially cased.

6. The system according to claim 1, wherein the second pipe string is substantially concentrically positioned within the first pipe string.

7. The system according to claim 1, wherein the difference between the inner diameter of the first pipe string and an outer diameter of the second pipe string is about one inch.

8. The system according to claim 1, wherein a ratio of an outer diameter of the second pipe string to the inner diameter of the first pipe string is greater than about 0.5.

9. The system according to claim 1, wherein an acceptable radius of curvature of the first pipe string is less than about three times an acceptable radius of curvature of the second pipe string.

10. A system for drilling a well having a wellbore comprising:

a first pipe string positioned in the wellbore, a first annulus present between the first pipe string and the wellbore;

a second pipe string, smaller in diameter than the first pipe string, positioned within the first pipe string to form a second annulus between the first pipe string and the second pipe string, the second pipe string configured to be attached to a drill bit;

a lubrication source in communication with the second annulus and capable of delivering a lubricant to the second annulus to reduce a coefficient of friction between the first pipe string and the second pipe string;

a fluid source at or near a surface of the well in communication with the second annulus to deliver a first fluid through the second annulus to the first annulus at a downhole location uphole of the drill bit; and wherein the first annulus receives a drilling fluid from the second pipe string and permits delivery of a mixture of the drilling fluid and the first fluid from the downhole location to the surface of the well;

wherein an inner diameter of the first pipe string is sized to be less than a diameter of the drill bit;

wherein the first pipe string and the second pipe string are each rotated at different speeds; and wherein in operation, the second pipe string is independently and axially moveable relative to the first pipe string.

11. The system according to claim 10, wherein the first fluid is a gas.

12. The system according to claim 10 further comprising:

a return conduit in communication with the first annulus to receive the mixture of the drilling fluid and the first fluid.

13. The system according to claim 10, wherein the first pipe string has a length less than a length of the second pipe string.

14. The system according to claim 10, wherein the wellbore is at least partially cased.

15. The system according to claim 10, wherein the second pipe string is substantially concentrically positioned within the first pipe string.

16. A system for drilling a well having a wellbore comprising:

a first pipe string positioned in the wellbore, a first annulus present between the first pipe string and the wellbore;

a second pipe string, smaller in diameter than the first pipe string, positioned within the first pipe string to form a second annulus between the first pipe string and the second pipe string, the second pipe string configured to be attached to a drill bit;

a rotator operably associated with the first pipe string to rotate the first pipe string; and a fluid source at or near a surface of the well in communication with the second annulus to deliver a first fluid through the second annulus to the first annulus at a downhole location uphole of the drill bit; and wherein the first annulus receives a drilling fluid from the second pipe string and permits delivery of a mixture of the drilling fluid and the first fluid from the downhole location to the surface of the well;

wherein the first pipe string and the second pipe string are each rotated at different speeds; and wherein in operation, the second pipe string is independently and axially moveable relative to the first pipe string.

17. The system according to claim 16 further comprising:

a second rotator operably associated with the second pipe string to rotate the second pipe string.

18. The system according to claim 17, wherein the first and second pipe strings are rotated in opposite directions.

19. The system according to claim 16, wherein the second pipe string is coil tubing.

20. The system according to claim 16, wherein an inner diameter of the first pipe string is sized to prevent passage of the drill bit through the first pipe string.

21. The system according to claim 16 further comprising:

a lubrication source in communication with the second annulus and capable of delivering a lubricant to the second annulus to reduce a coefficient of friction between the first pipe string and the second pipe string.

22. A method for drilling a well having a wellbore comprising:

inserting a drill string operably attached to a drill bit into the wellbore;

after inserting the drill string, inserting a parasite string within the wellbore such that at least a portion of the drill string is within the parasite string;

rotating the drill string at a first speed; and rotating the parasite string at a second speed to decrease a friction force between the drill string and the parasite string.

23. The method according to claim 22, wherein the drill string and the parasite string are rotated in opposite directions.

24. The method according to claim 22, wherein:

the drill string and the parasite string are rotated in the same direction; and the first speed and the second speed are different.

25. The method according to claim 22, wherein the second speed is from about one to ten revolutions per minute.

26. A method for drilling a well having a wellbore comprising:

inserting a drill string operably attached to a drill bit into the wellbore;

after inserting the drill string, inserting a parasite string within the wellbore such that at least a portion of the drill string is within the parasite string;

delivering a drilling fluid through the drill string to the drill bit;

returning the drilling fluid to a surface of the well through a first annulus formed between the parasite string and the wellbore;

delivering a first fluid through a second annulus to a downhole location uphole of the drill bit, the second annulus being present between the drill string and the parasite string; and combining the first fluid and the drilling fluid in the first annulus at the downhole location;

wherein an inner diameter of the parasite string is sized to be less than a diameter of the drill bit.

27. The method according to claim 26 further comprising:

rotating the drill string to decrease a friction force between the drill string and the parasite string.

28. The method according to claim 26 further comprising:

rotating the parasite string to decrease a friction force between the drill string and the parasite string.

29. The method according to claim 26 further comprising:

rotating the drill string to at a first speed to turn the drill bit; and rotating the parasite string at a second speed to decrease a friction force between the drill string and the parasite string.

30. The method according to claim 29, wherein the drill string and the parasite string are rotated in opposite directions.

31. The method according to claim 29, wherein:

the drill string and the parasite string are rotated in the same direction; and the first speed and the second speed are different.

32. The method according to claim 29, wherein the second speed is from about one to ten revolutions per minute.

33. The method according to claim 29 further comprising:

delivering a lubricant to the second annulus to reduce a coefficient of friction between the drill string and the parasite string.

34. A system for drilling a well having a wellbore comprising:

a first pipe string positioned in the wellbore, a first annulus present between the first pipe string and the wellbore;

a second pipe string, smaller in diameter than the first pipe string, positioned within the first pipe string to form a second annulus between the first pipe string and the second pipe string, the second pipe string configured to be attached to a drill bit;

a rotator operably associated with the first pipe string to rotate the first pipe string; and a lubrication source in communication with the second annulus and capable of delivering a lubricant to the second annulus to reduce a coefficient of friction between the first pipe string and the second pipe string;

wherein the first pipe string and the second pipe string are each rotated at different speeds;

wherein in operation, the second pipe string is independently and axially moveable relative to the first pipe string.

* * * * *